US012458131B1

(12) United States Patent
Herd

(10) Patent No.: US 12,458,131 B1
(45) Date of Patent: Nov. 4, 2025

(54) MODULAR SLING BAGS WITH WRAPAROUND FASTENERS

(71) Applicant: Herd Enterprises Inc., Surrey (CA)

(72) Inventor: Brian Herd, Surrey (CA)

( * ) Notice: Subject to any disclaimer, the term of this patent is extended or adjusted under 35 U.S.C. 154(b) by 425 days.

(21) Appl. No.: 18/194,594

(22) Filed: Mar. 31, 2023

(51) Int. Cl.
*A45F 3/02* (2006.01)

(52) U.S. Cl.
CPC ..... *A45F 3/02* (2013.01)

(58) Field of Classification Search
CPC ... A45C 13/30; A45C 3/001; A45F 2003/142; A45F 2003/144; A45F 2003/148; A45F 3/02; A45F 3/14; A45F 5/00; A45F 5/021
USPC ..... 224/582; D3/224
See application file for complete search history.

(56) References Cited

U.S. PATENT DOCUMENTS 6,913,176 B1 * 7/2005 Buscemi ..... A45F 5/021 224/665
7,870,982 B2 * 1/2011 Dong ..... A45F 3/14 224/257
2006/0226180 A1 10/2006 Hubbell
2013/0269844 A1 10/2013 Gyuran
2016/0015156 A1 1/2016 Hunter
2016/0360862 A1 * 12/2016 Camacho ..... A45F 3/02
2017/0360009 A1 * 12/2017 Anderson ..... A45F 3/02
2019/0191853 A1 * 6/2019 Carter ..... A45F 3/14
2023/0130075 A1 * 4/2023 Shemwell ..... A45F 5/1566 224/148.5

FOREIGN PATENT DOCUMENTS

DE 202005018744 U1 * 1/2006 ..... A45F 5/021

OTHER PUBLICATIONS

DE-202005018744-U1 Translation, Jan. 26, 2006 (Year: 2006).*

* cited by examiner

*Primary Examiner* — Nathan J Newhouse
*Assistant Examiner* — Matthew T Theis
(74) *Attorney, Agent, or Firm* — Miller IP Law; Devin Miller

(57) ABSTRACT

Described herein are examples of sling belt device. The sling belt has a belt with a front portion including the first component of a hook and loop fastener, a first container and a second container releasably attached to the front portion. The containers have an inside attachment flap having inner surface and an outer surface and an outside attachment flap having an inner and surface and an outer surface. Complementary components of a hook and loop fastener. Attach the containers to the belt by the first component. The complementary components contain a first complementary element on the inner surface of the inner attachment flap engaging the first component, a second complementary element on the outer surface of the inner attachment flap, a first element on the inner surface of the outer attachment flap, overlapping the inner attachment flap, and engaging the second complementary element.

19 Claims, 14 Drawing Sheets

MODULAR SLING BAGS WITH WRAPAROUND FASTENERS

BACKGROUND

This invention relates to devices used as alternatives or complements to backpacks used to carry accessories. For example, fanny bags or sling bags can be used by travelers to carry a cell phone, glasses/sunglasses, a wallet, a passport, key(s), loose change, or any other small essential items. Compartmentalizing the devices has led to increase their effectiveness and providing modular compartments has led to increases in their flexibility.

BRIEF DESCRIPTION OF THE DRAWINGS

The present description will be understood more fully when viewed in conjunction with the accompanying drawings of various examples of a modular sling bag with wrap around fasteners. The description is not meant to limit the modular sling bag with wrap around fasteners to the specific examples. Rather, the specific examples depicted and described are provided for explanation and understanding of the modular sling bag with wrap around fasteners. Throughout the description the drawings may be referred to as drawings, figures, and/or FIGs.

DETAILED DESCRIPTION

A modular sling bag with wraparound fasteners as disclosed herein will become better understood through a review of the following detailed description in conjunction with the figures. The detailed description and figures provide merely examples of the various embodiments of the modular sling bag. Many variations are contemplated for different applications and design considerations, however, for the sake of brevity and clarity, all the contemplated variations may not be individually described in the following detailed description. Those skilled in the art will understand how the disclosed examples may be varied, modified, and altered and not depart in substance from the scope of the examples described herein.

A conventional belt bag may include a one to two inch belt having one or more small pouches stitched onto the belt. Additionally, some conventional belt bags are designed with one or more interchangeable pouches. Such pouches are removably attached to the belt using various different attachment devices, including snaps, belts, zippers, hooks, loop fasteners (VELCRO) and the like.

Conventional belt bags are widely utilized in an ever increasing number of activities, such as travel, sporting events, hiking, running, and fishing. The use of these bags allows the user to carry, for example, a cell phone, car keys, credit cards, water bottles, a camera, or a key holder without the inconvenience of a full-sized backpack.

It is a drawback of such removeable pouches that they can easily become accidently separated from the belt during the course of the activities. Consequently, there is a definite need for a sling bag having interchangeable pouches that are both removable and securely attached. There presently are no practical belt pack systems that provide for the secure attachment of freely interchangeable containers on a belt. The user is limited to the existing removable containers which may not be sufficiently secure to remain attached during every desired activity. There simply has been no effective solution to the above-described problem prior to the present invention.

Implementations of the modular sling belt with wraparound fasteners may address some or all of the problems above. The modular sling bag has a sleek, slender, minimalistic design easily fitting under a jacket or coat. The modular sling bag provides a lightweight and comfortable way to have ready access to such items as a cellphone, a wallet, keys, glasses, and a passport.

The removable modules provide interchangeable and rearrangeable compartment modules for selective use in the differing activities of the wearer.

The removable modules are secured by a wraparound fastener to prevent the modules from becoming accidently separated from the belt. The wraparound fasteners include one component of a hook and loop fastener, the hook and loop fastener including a hook component or a loop component extending along part of the front surface of the belt.

Figure 1:
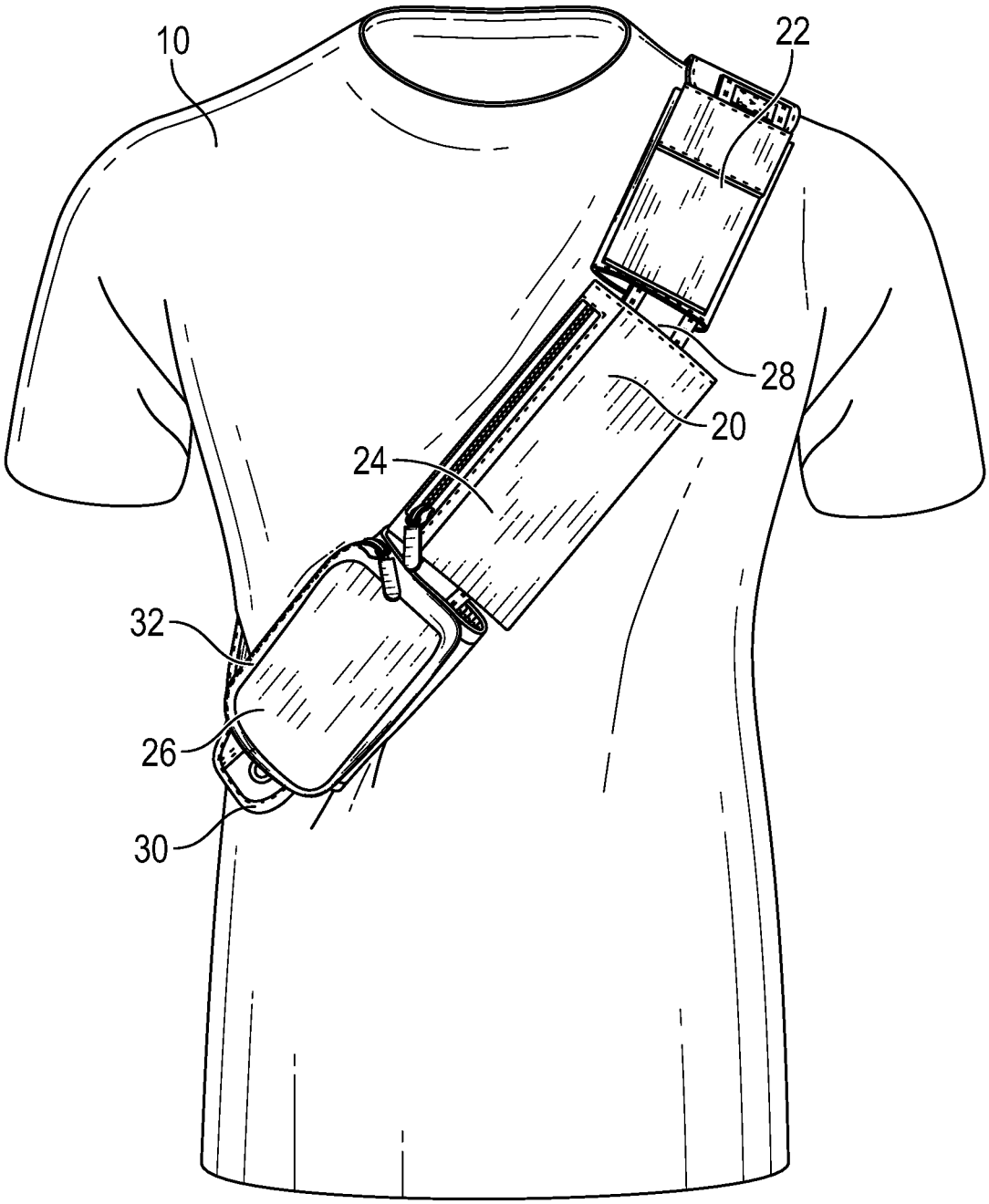
FIG. 1 illustrates a user wearing a modular sling belt containing three storage pouches with wraparound fasteners, according to an embodiment.

FIG. 1 is a front perspective view illustrating a user 10 wearing a modular sling belt 20, In the embodiment shown in FIG. 1, the modular sling belt 20 is configured to position over the shoulder and across the torso of a user. In the representative embodiment, the modular sling belt 20 comprises three pouches or containers, a first storage pouch 22, a second storage pouch 24 and a third storage pouch 26, releasably attached to a belt or strap 28.

The strap 28 has a front portion 30 and a back portion 32. The strap 28 can be made of any suitable material. Such materials may include, but are not limited to, cotton, vinyl, polypropylene, nylon, polyester, elastic, wool, or leather. In some embodiments, the strap 28 is made of a polyester or nylon seat belt webbing. The strap typically has a width of from 1 inch to 3 inches and in some embodiments 2 inches.

While three interchangeable storage pouches are shown in the representative figure, the invention is useful for modular sling bags equipped with one or more removable containers or pouches. Storage pouches can be removed, exchanged, or added according to the specific needs of the user.

Figure 2:
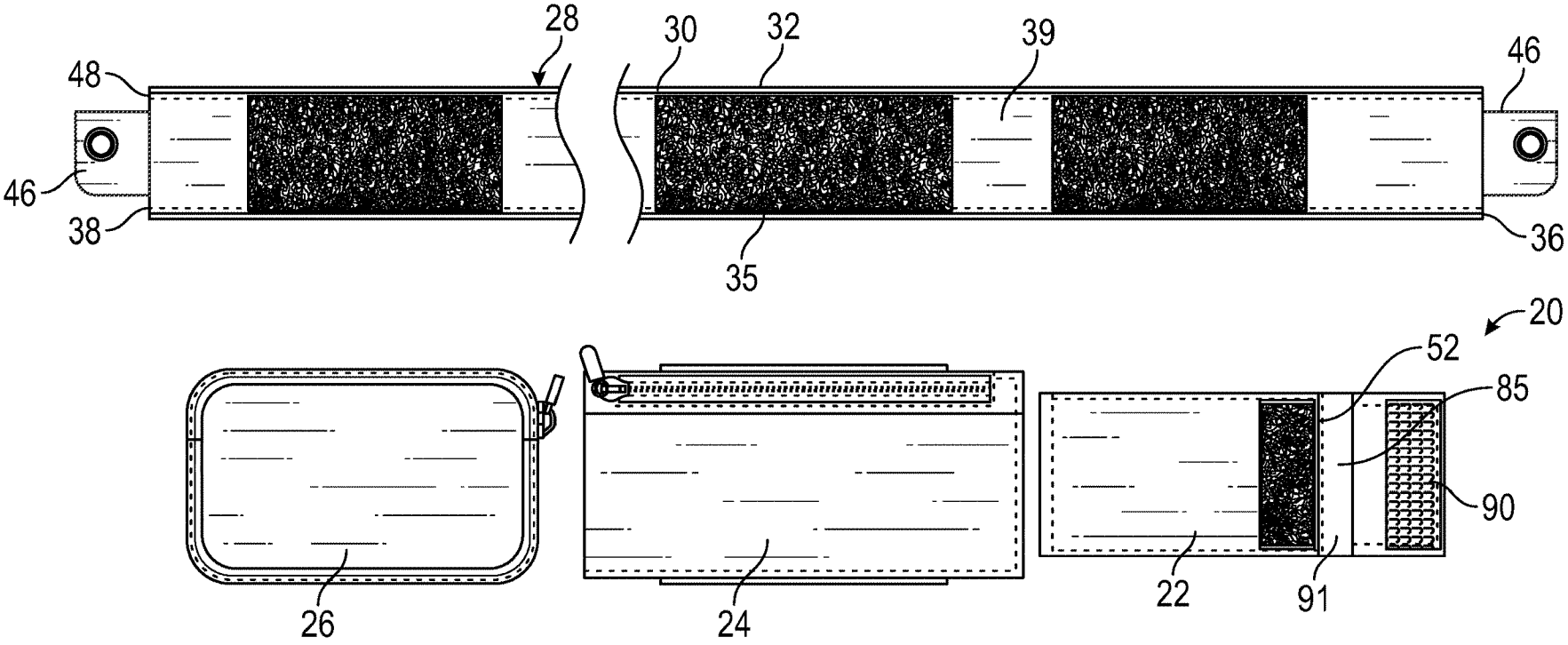
FIG. 2 illustrates the front portion of the modular sling of FIG. 1 in an embodiment.

FIG. 2 is an exploded front elevational view illustrating the front portion 30 and the back portion 32 of the modular sling bag 20 shown in FIG. 1 with the three storage pouches 22, 24 and 26 removed from the strap 28. In the embodiment shown in FIG. 2, the front portion 30 has a front surface 35, a top end 36, a bottom end 38 and a first component 39 of a hook and loop fastener. A hook and loop fastener includes a first component and a second complementary component. In the representative embodiment shown in the figures, the first component is a loop fastener and the second complementary component is a hook fastener. In other embodiments, the first component is a hook component and the second complementary component is a loop component. In the embodiment shown in FIG. 2, the loop component 39 is on the front surface 35 of the front portion 20 and extends along the front surface 35.

In some embodiments, the modular sling bag 20 includes a shoulder pad 46 located between the top end 36 of the front portion 30 and the back portion 32. And in some embodiments, the modular sling bag 20 includes a fastener release buckle 48 located between the bottom end 38 of the front portion 30 and the back portion 32. In some embodiments, the modular sling bag 20 additionally includes a carabiner clip 46 located at the bottom end 38 of the front portion 30.

Figure 3A:
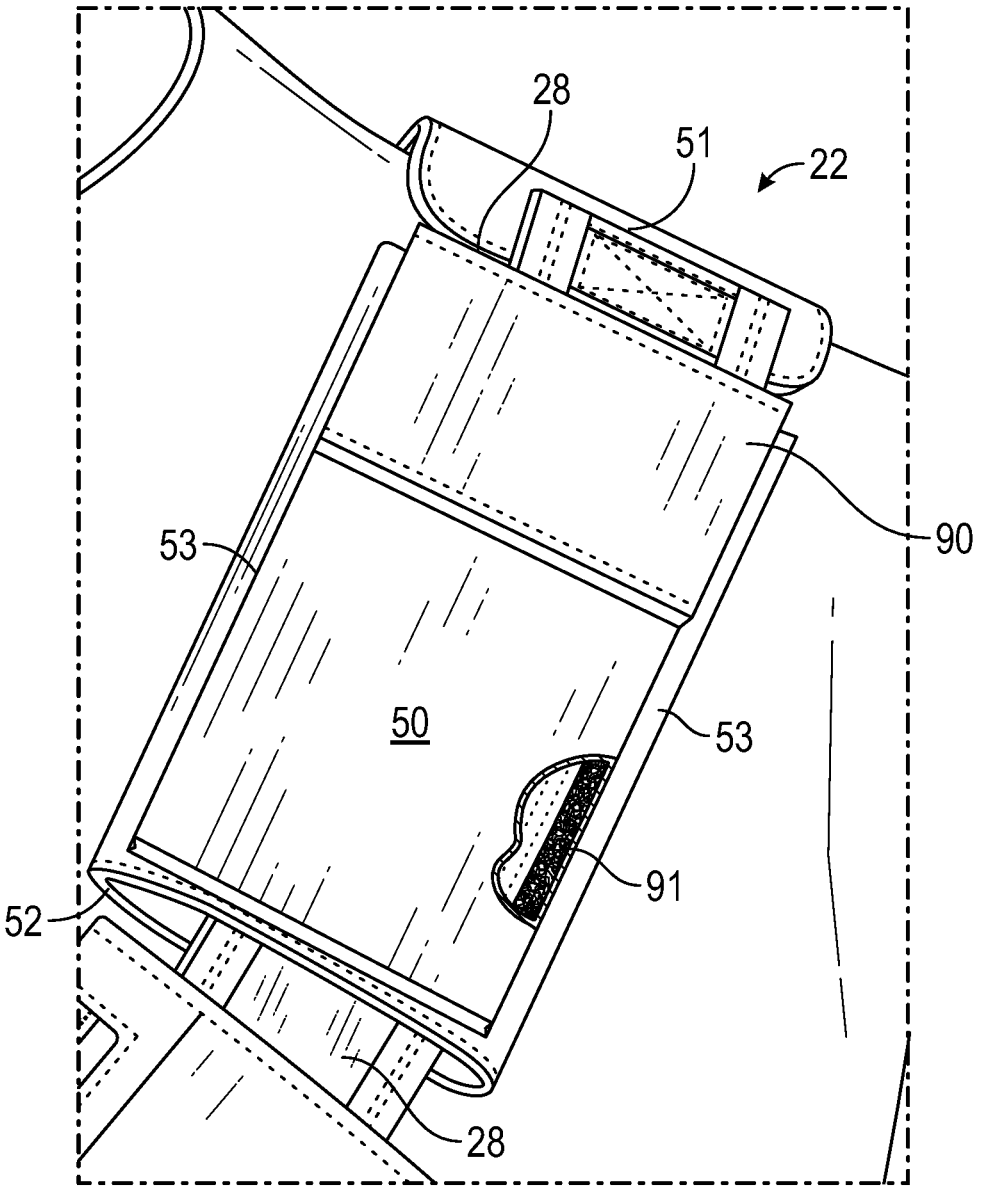
FIG. 3A illustrates a storage pouch and a portion of a strap of FIG. 1 in a first embodiment.

FIG. 3A is a front perspective view illustrating the first container 22 along with a portion of the strap 28 as shown in FIG. 1. In the embodiment shown in FIG. 3A, the first container 22 is cubic in shape. In other embodiments the container can be of any suitable shape, such as containers have a circular or oblong or other geometric shape.

An enclosure 47 is defined by a top surface 50 having a top 51, a bottom 52 and first and second opposing sides 53 and, in some embodiments, the first container has a length from 7 inches to 5 inches, a width of from 4 inches to 2.5 inches and a height of 0.5 inch to 1.5 inches. In the embodiment shown in FIG. 3A, the first container 22 has a length of 7 inches, a width of 3 inches and a height of 1 inch.

In some embodiments, the first container 22 additionally includes a closure providing access to the enclosure 47. In the embodiment shown in FIG. 3A, the closure is a closure flap 90 movable between secured and unsecured positions extending from the top of the bottom surface. Referring additionally to FIG. 2, the closure flap includes a hook and loop fastener 91 securing the closure flap to the top 51 of the top surface 50 to provide access to the enclosure. FIG. 2 illustrates the closure flap 84 in its unsecured position and FIG. 3A illustrates the closure flap in its secured position.

Figure 3B:
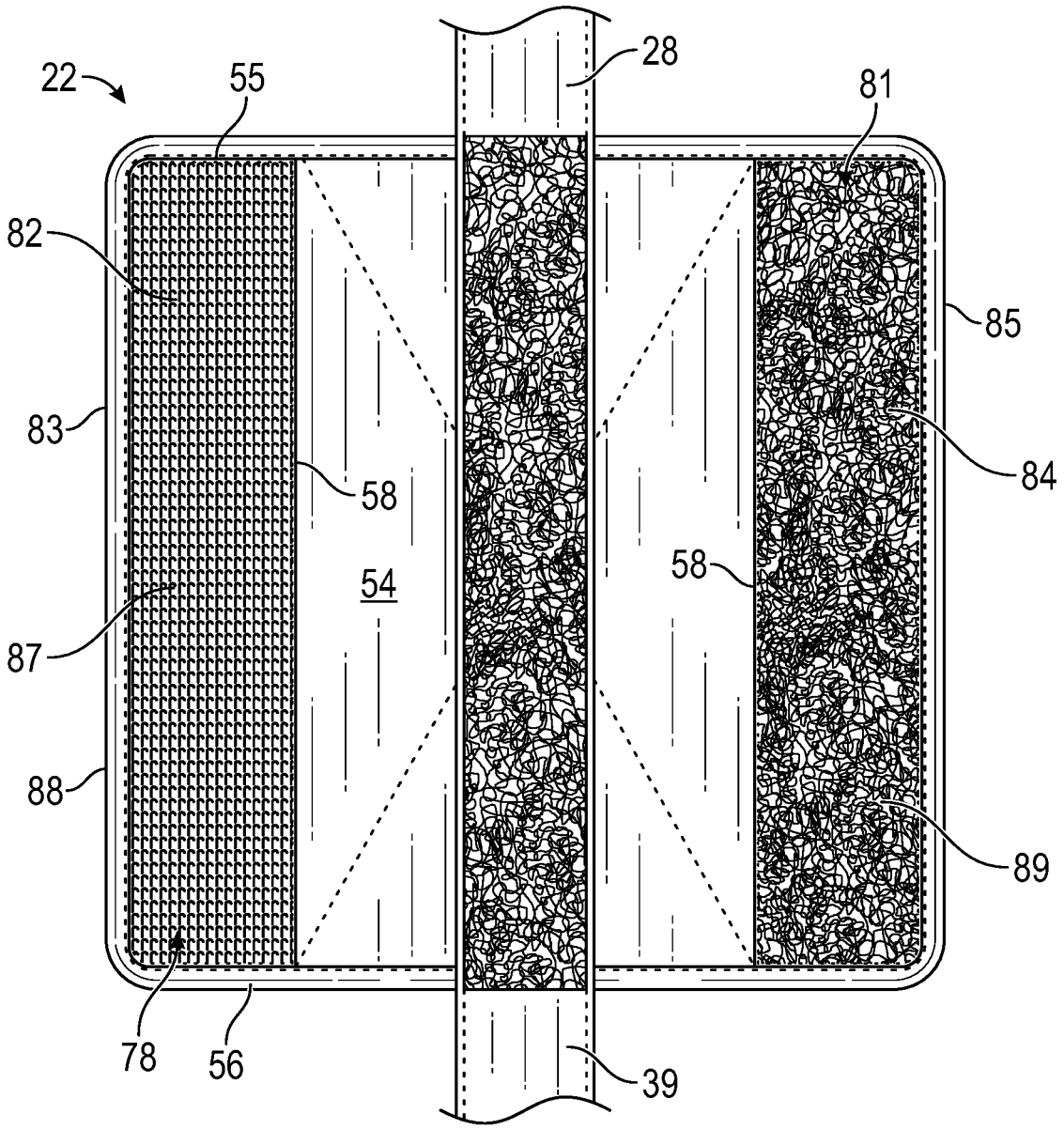
FIG. 3B illustrates a storage pouch and a portion of a strap of FIG. 3A with a wraparound hook and loop fastener component in an unsecured configuration in a first embodiment.

FIG. 3B is a back perspective view illustrating the first storage pouch 22 and a portion of the strap 28 in an unsecured position. The back of the first storage pouch 22 has a bottom surface 54 with a top 55, a bottom 56, and a pair of opposing sides 58.

The first container 22 includes an inside attachment flap 78 and an outside attachment flap 81. The inside attachment flap 78 has an inner surface 82 and an outer surface 83. The outside attachment flap 81 has an inner surface 84 and an outer surface 85. The flaps extend from one of the first and the second opposing sides 58, respectively, and the flaps are movable between secured and unsecured positions. In the embodiment shown in FIG. 3B, both the inside attachment flap 78 and the outside attachment flap 81 are in their unsecured positions. In some embodiments, the attachment flaps have a length of from 7 inches to 5 inches and a width of 4 inches to 1.5 inches. In the embodiment shown in FIG. 3B, the attachment flaps have a length of 7 inches and a width of 2 inches.

A second complementary component releasably secures the first storage pouch 22 to the strap 28 by affixing to the strap's first component 39. The second complementary component includes a first complementary element 87, a second complementary element 88 and a first element 89. The first complementary element 87 is on the inner surface 82 of the inside attachment flap 78. It extends the length of the inner surface 82 of the inside attachment flap 78. The second complementary element 88 is on the outer surface 83 of the inside attachment flap 78. It extends the length of the outer surface 83 of the inside attachment flap 78. The first element 89 is on the inner surface 85 of the outside attachment flap 81. It extends the length of the inner surface 84 of the outside attachment flap 81. In the representative embodiment shown in FIG. 3B, the first complementary element 87 is a hook element, the second complementary element 88 is a hook element and the first element 89 is a loop element. The second complementary element shown in FIG. 3B is in the completely unsecured position, with no engagement between any of the hook and loop fasteners.

Figure 3C:
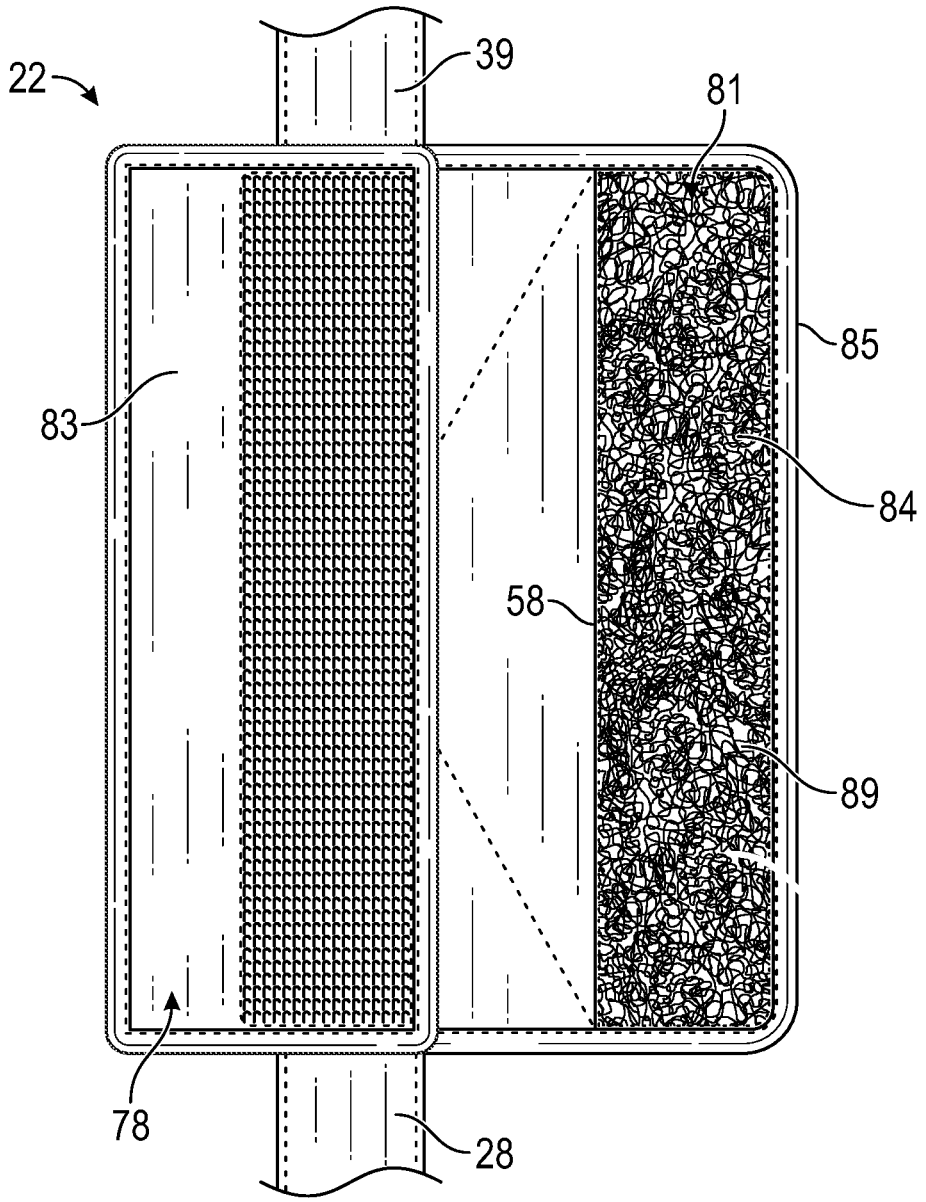
FIG. 3C illustrates a storage pouch and a portion of a strap of FIG. 3A with a wraparound hook and loop fastener component in a partially secured configuration in a first embodiment.

FIG. 3C is a back perspective view illustrating the first storage pouch 22 and a portion of the strap 28 in a partially secured position. In the representative embodiment shown in FIG. 3C, the first hook element 87 on the inner surface 82 of the inside attachment flap 78 engages the loop element 89 on the front surface 39 of the strap 28.

Figure 3D:
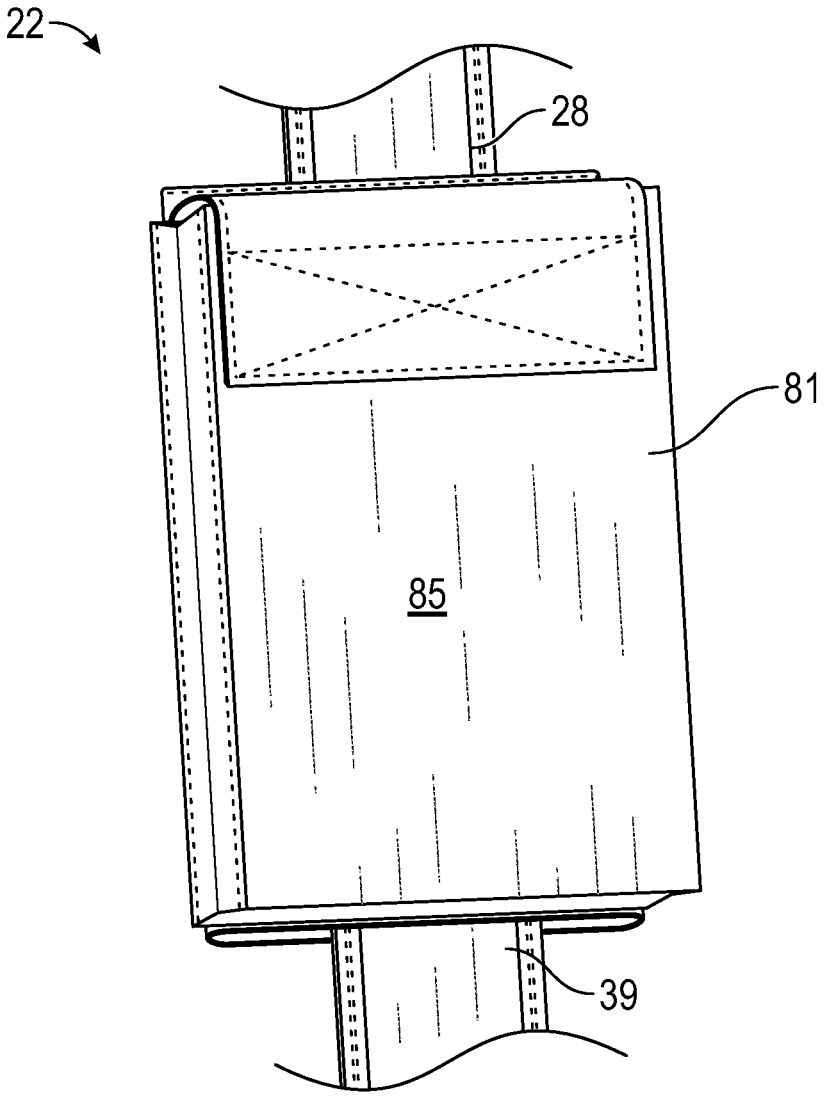
FIG. 3D illustrates a storage pouch and a portion of a strap of FIG. 3A with a wraparound hook and loop fastener component in a completely secured configuration in a first embodiment.

FIG. 3D is a back perspective view illustrating the first storage pouch 22 and a portion of the strap 28 in a completely secured position. In the representative embodiment shown in FIG. 3D, the first hook fastener 87 on the inner surface 82 of the inside attachment flap 78 engages the loop component 39 on the front surface 35 of the strap 28 and the loop fastener 89 on the inner surface 85 of the outside attachment flap 81 engages the second hook element on the outer surface 83 of the inside attachment flap 78.

The configuration of the first container makes it especially suitable for storing cell phones.

Figure 4A:
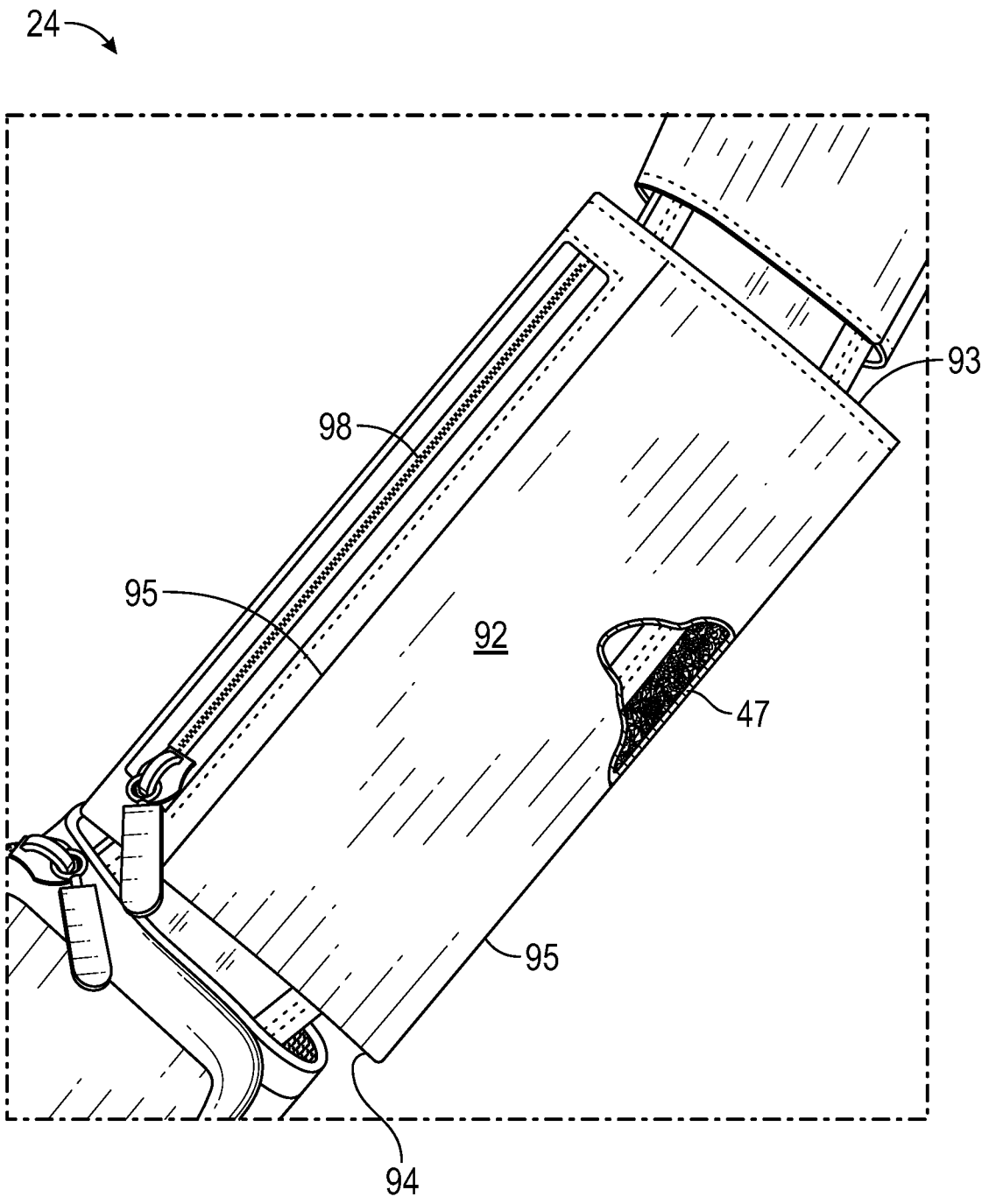
FIG. 4A illustrates a storage pouch and a portion of a strap of in FIG. 1 in a second embodiment.

FIG. 4A is a front perspective view illustrating the second container 24 as shown in FIG. 1. In the embodiment shown in FIG. 4A, the second container 24 is cubic in shape. In other embodiments the container can be of any suitable shape, such as containers have a circular or oblong or other geometric shape.

An enclosure 91 is defined by a top surface 92 having a top 93, a bottom 94 and first and second opposing sides 95. In some embodiments, the second container has a length from 7 inches to 5 inches, a width of from 4 inches to 2.5 inches and a height of 0.5 inch to 1.5 inch. In the embodiment shown in FIG. 4A, the second container has a length of 7 inches, a width of 3 inches and a height of 0.5 inch.

In some embodiments, the second container 24 includes a closure providing access to the enclosure 91. In the embodiments shown in FIG. 4A, the closure is a zipper 98 located in the top surface 92 adjacent one of the opposing sides 95.

Figure 4B:
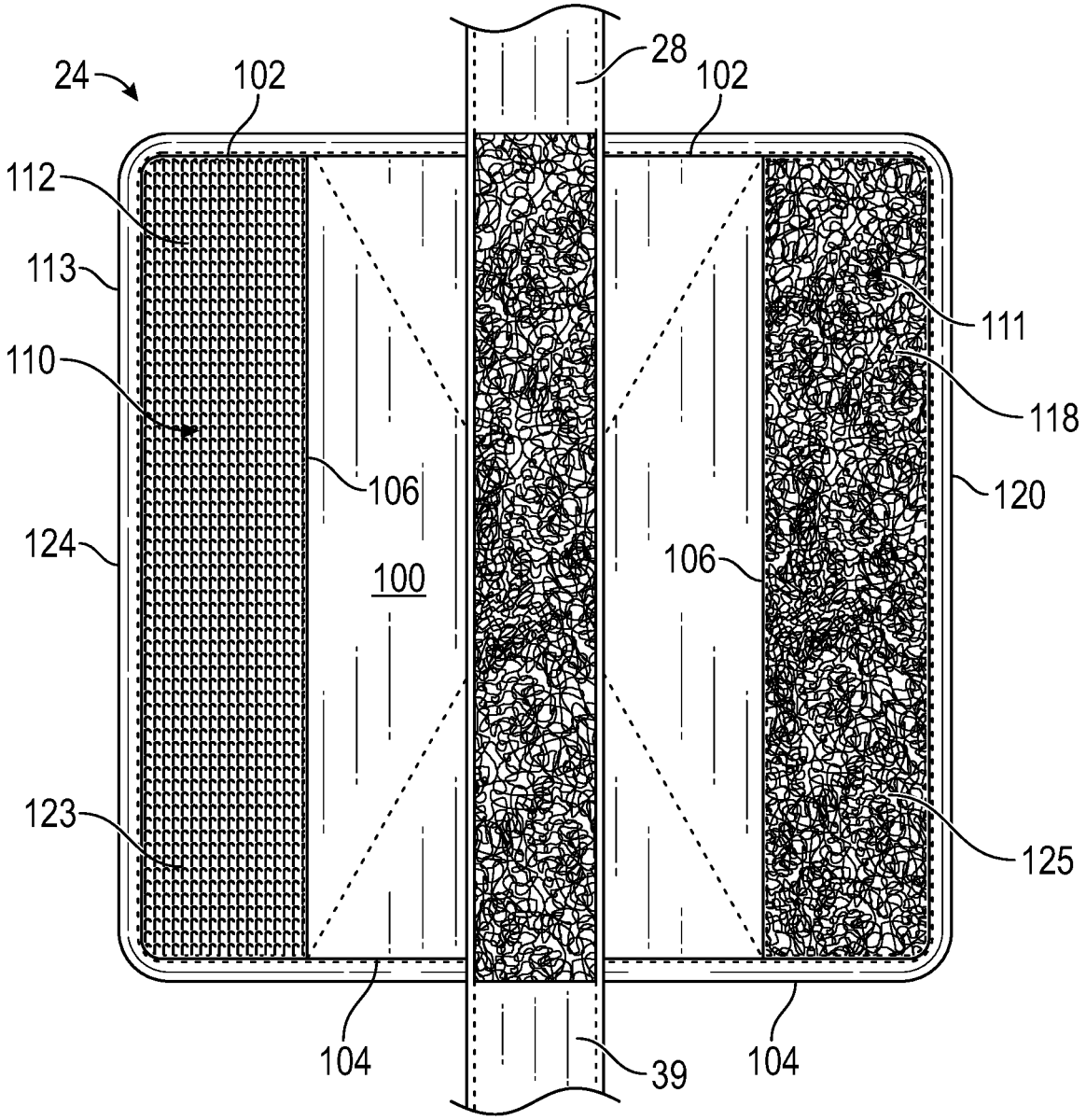
FIG. 4B illustrates a storage pouch and a portion of a strap of FIG. 4A with a wraparound hook and loop fastener component in an unsecured configuration in a second embodiment.

FIG. 4B is a back perspective view illustrating the second container 24 and a portion of the strap 28 in an unsecured position. The back of the second container 24 has a bottom surface 100 having a top 102, a bottom 104, and a pair of first and second opposing sides 106. The second container includes an inside attachment flap 110 and an outside attachment flap 111. The inside attachment flap 110 has an inner surface 112 and an outer surface 113. The outside attachment flap 111 has an inner surface 118 and an outer surface 120. The flaps extend from the first and second opposing sides 106, respectively, and flaps are movable between secured and unsecured positions. In the embodiment shown in FIG. 4B, the inside attachment flap 110 is in a secured position and the outside attachment flap 111 is in an unsecured position. In some embodiments, the attachment flaps have a length of from 7 inches to 5 inches and a width of 4 inches to 1.5 inches. In the embodiment shown in FIG. 4B, the attachment flaps have a length of 7 inches and a width of 2 inches.

A second complementary component releasably secures the second storage pouch 24 to the strap 28 by affixing to the strap's front portion loop component 39. The second complementary component includes a first complementary element 123, a second complementary element 124 and a first element 125. The first complementary element 123 is on the inner surface 112 of the inside attachment flap 110. It extends the length of the inner surface 112 of the inside attachment flap 110 and engages the first portion loop component 39. The second complementary element 124 is on the outer surface 113 of the inside attachment flap 110. It extends the length of the outer surface 113 of the inside attachment flap 110. The first element 125 is on the inner surface 118 of the outside attachment flap 111. It extends the length of the inner surface 118 of the outside attachment flap 111, overlaps the inside attachment flap 110 and engages the inner surface 118 of the outside attachment flap 111. In the representative embodiment shown in FIG. 4B, the first complementary element 123 is a hook element, the second complementary element 124 is a hook element and the first element 125 is a loop element.

Figure 4C:
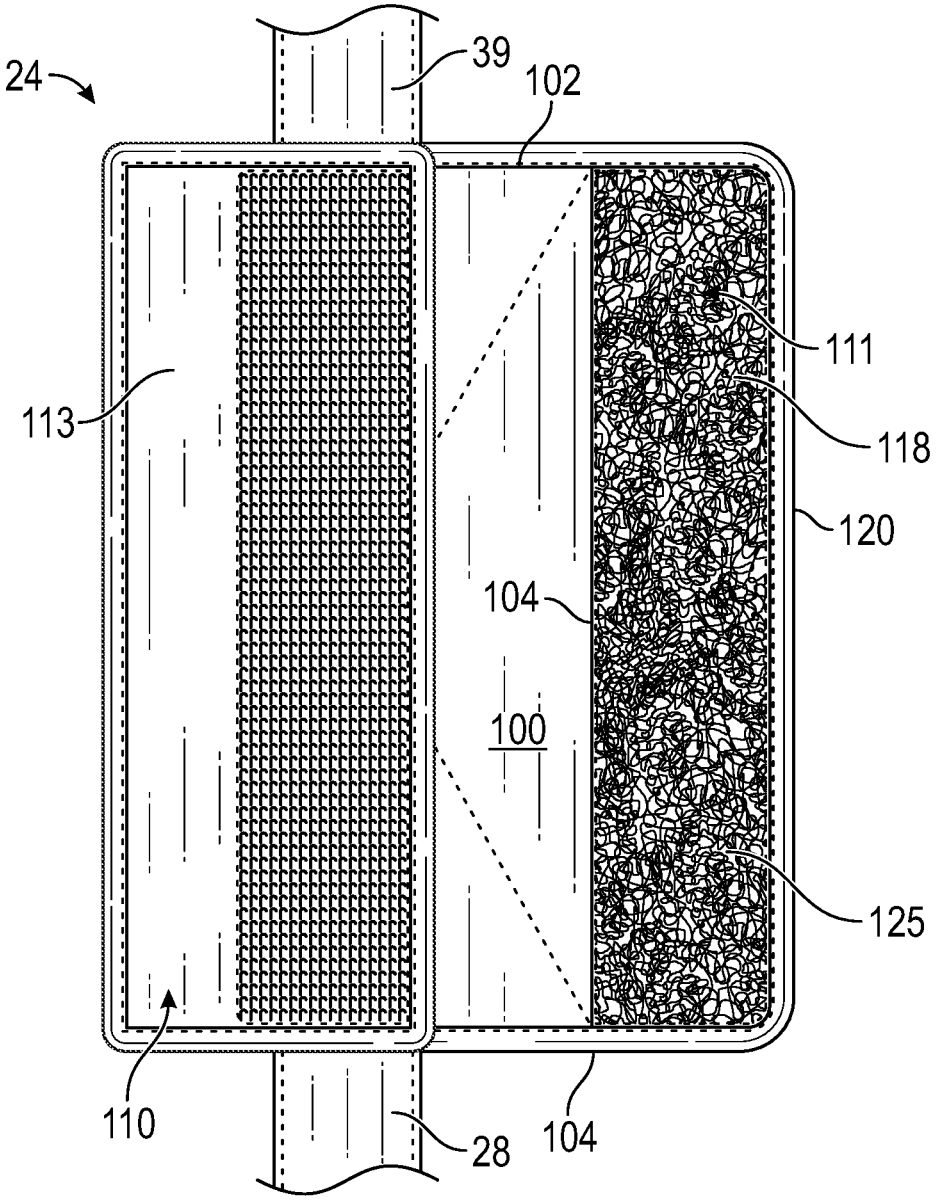
FIG. 4C illustrates a storage pouch and a portion of a strap of FIG. 4A with a wraparound hook and loop fastener component in a partially secured configuration in a second embodiment.

FIG. 4C is a back perspective view illustrating the second storage pouch 24 and a portion of the strap 28 in a partially secured position. In the representative embodiment shown in FIG. 4C, the first complementary element 123 on the inner surface 112 of the inside attachment flap 110 engages the front portion loop component 39 on the front surface 35 of the strap 28.

Figure 4D:
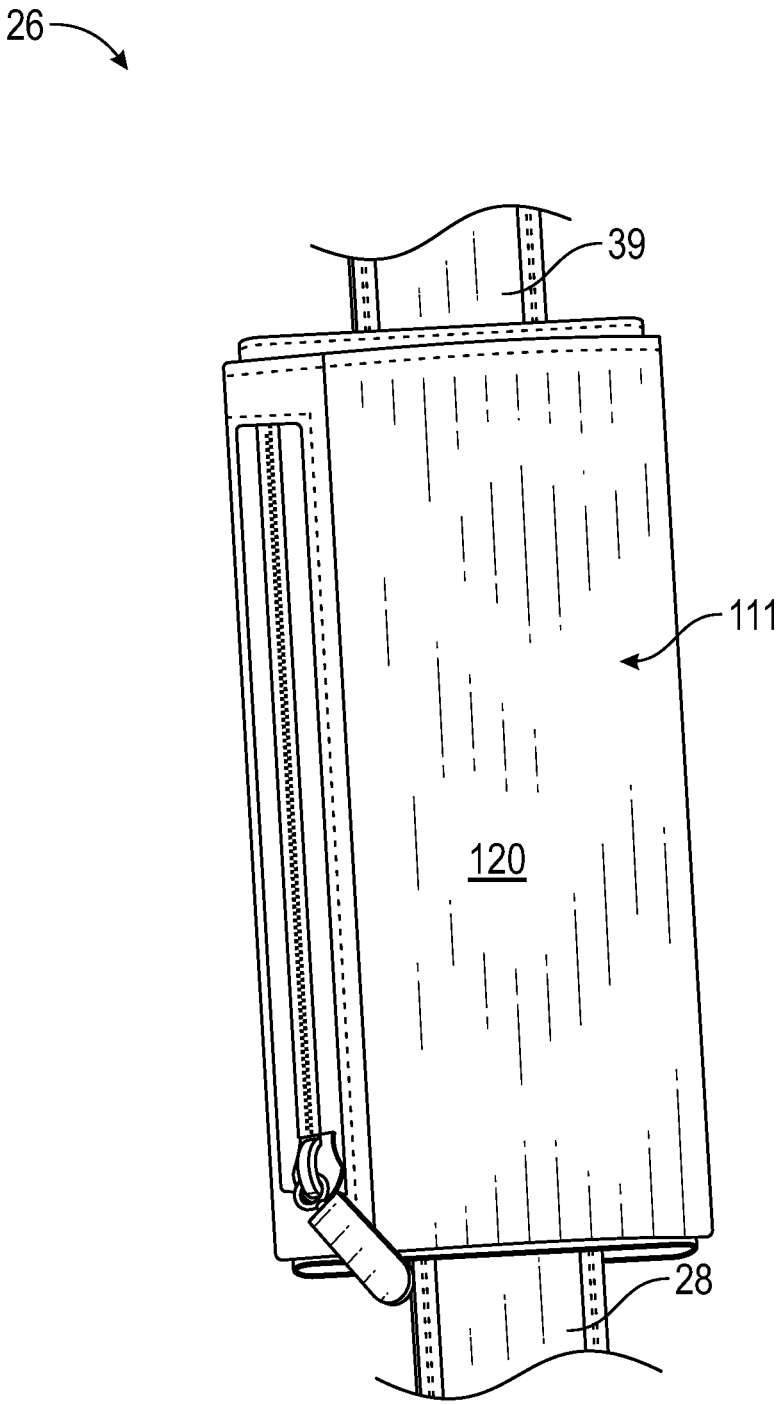
FIG. 4D illustrates a storage pouch and a portion of a strap of in FIG. 4A with a wraparound hook and loop fastener component in a completely secured configuration in a second embodiment.

FIG. 4D is a back perspective view illustrating the second storage pouch 24 and a portion of the strap 28 in a completely secured position. In the representative embodiment shown in FIG. 3D, the first complementary element 123 on the inner surface 112 of the inside attachment flap 110 engages the first portion loop component 39 on the front surface 35 of the strap 28 and the first element 125 on the inner surface 118 of the outside attachment flap 111 engages the second complementary element 124 on the outer surface 113 of the inside attachment flap 110.

The configuration of the second container 24 makes it especially suitable for storing glasses.

Figure 5A:
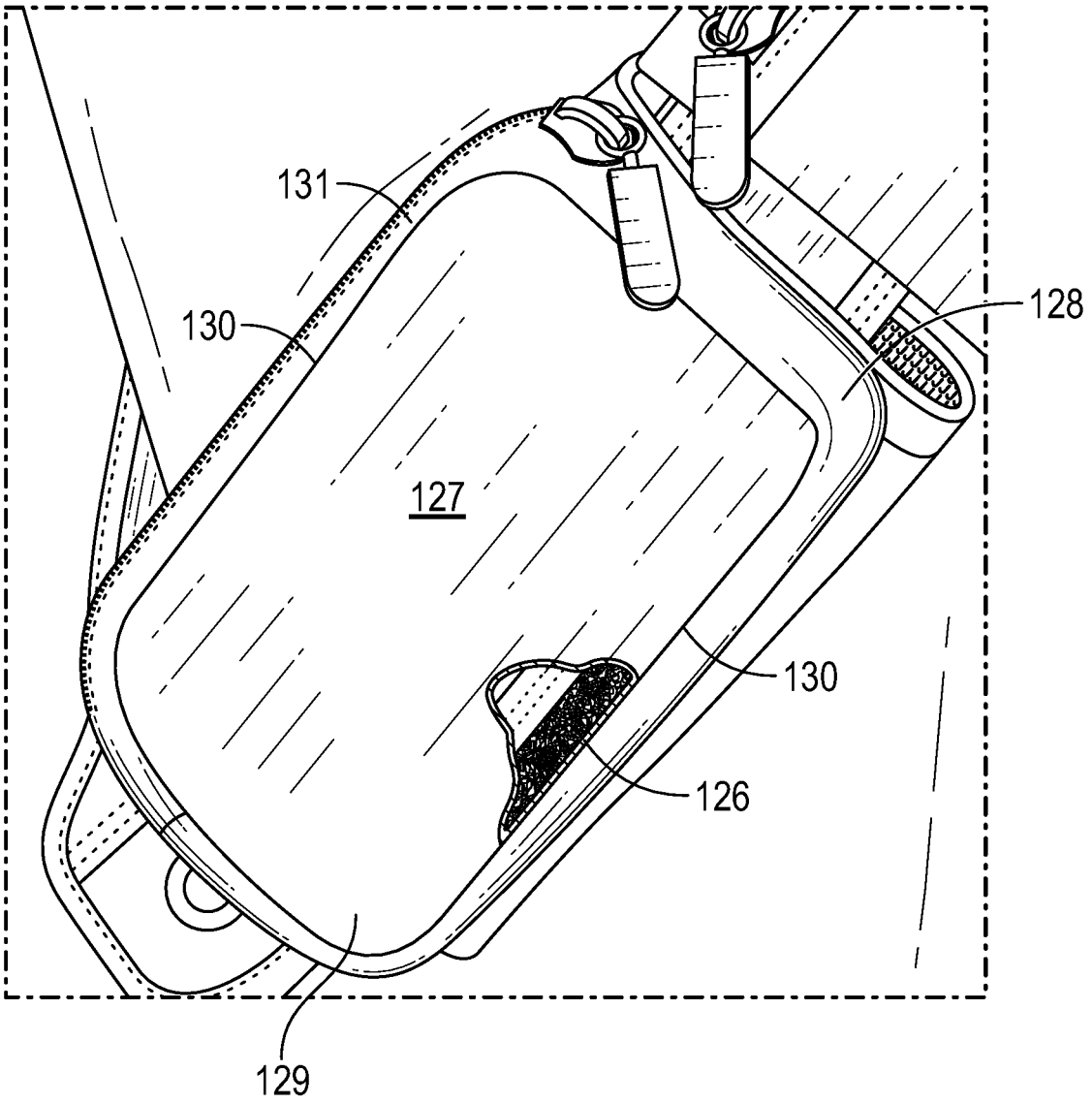
FIG. 5A illustrates a storage pouch and a portion of a strap of FIG. 1 in a third embodiment.

FIG. 5A is a front perspective view illustrating the third container 26 of FIG. 1. In the embodiment shown in FIG. 5A, the third container is cubic in shape. In other embodiments the container can be of any suitable shape, such as containers have a circular or oblong or other geometric shape.

An enclosure 126 is defined by a top surface 127 having a top 128, a bottom 129 and first and second opposing sides 130. In some embodiments, the third container 26 has a length from 7 inches to 5 inches, a width of from 4 inches to 2.5 inches and a height of 0.5 inch to 1.5 inch. In the embodiment shown in FIG. 5A, the third container has a length of 5.5 inches, a width of 3.5 inches and a height of 1 inch.

In some embodiments, the third container 26 additionally includes a closure providing access to the enclosure 126. In the embodiments shown in FIG. 5, the closure is a zipper 131 located in one of the first and second opposing sides 130.

Figure 5B:
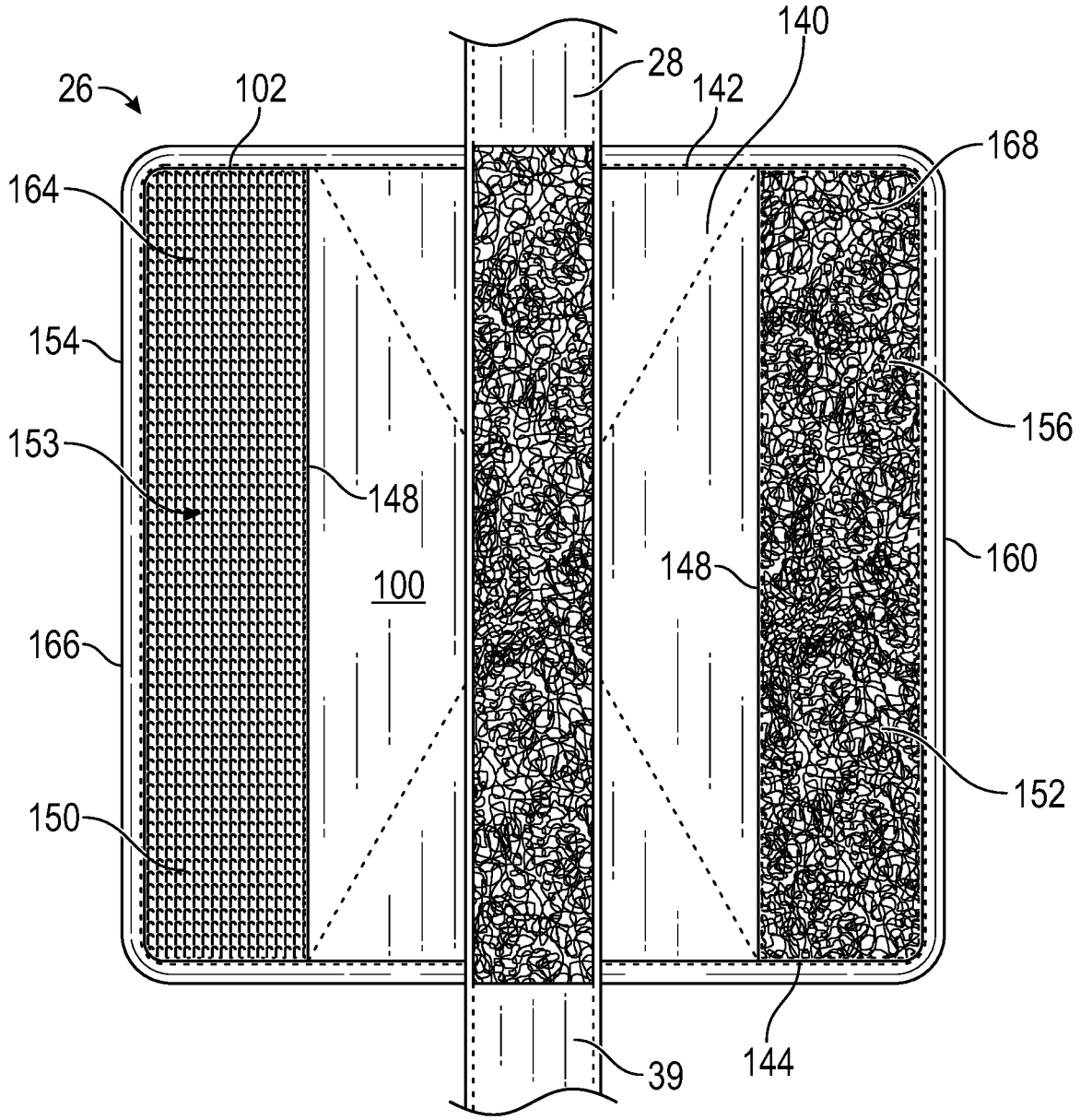
FIG. 5B illustrates a storage pouch and a portion of a strap of FIG. 5A with a wraparound hook and loop fastener component in an unsecured configuration in a third embodiment.

FIG. 5B is a back perspective view illustrating the third container 26 and a portion of the strap 28 in an unsecured position. The back of the third container 26 has a bottom surface 140 having a top 142, a bottom 144, and a pair of opposing sides 148. The third container 26 includes an inside attachment flap 150 and an outside attachment flap 152. The inside attachment flap 150 has an inner surface 153 and an outer surface 154. The outside attachment flap 152 has an inner surface 158 and an outer surface 160. The flaps extend from the first and the second opposing sides 148, respectively, and the flaps are movable between secured and unsecured positions. In the embodiment shown in FIG. 4B, the inside attachment flap 110 is in a secured position and the outside attachment flap 111 is in an unsecured position. In some embodiments, the attachment flaps have a length of from 7 inches to 5 inches and a width of 4 inches to 1.5 inches. In the embodiment shown in FIG. 5B the attachment flaps have a length of 5 inches and a width of 2 inches.

A second complementary component releasably secures the third storage pouch 26 to the strap 28 by affixing to the front portion loop component 39 of a hook and loop fastener. The second complementary component includes a first complementary element 164, a second complementary element 166 and a first element 168. The first complementary element 164 is on the inner surface 153 of the inside attachment flap 150. It extends the length of the inner surface 153 of the inside attachment flap 150. The second complementary element 166 is on the outer surface 154 of the inside attachment flap 150. It extends the length of the outer surface 154 of the inside attachment flap 150. The first element 168 is on the inner surface 158 of the outside attachment flap 152. It extends the length of the inner surface 158 of the outside attachment flap 152. In the representative embodiment shown in FIG. 5B, the first complementary element 164 is a hook element, the second complementary element 166 is a hook element and the first element 168 is a loop element.

Figure 5C:
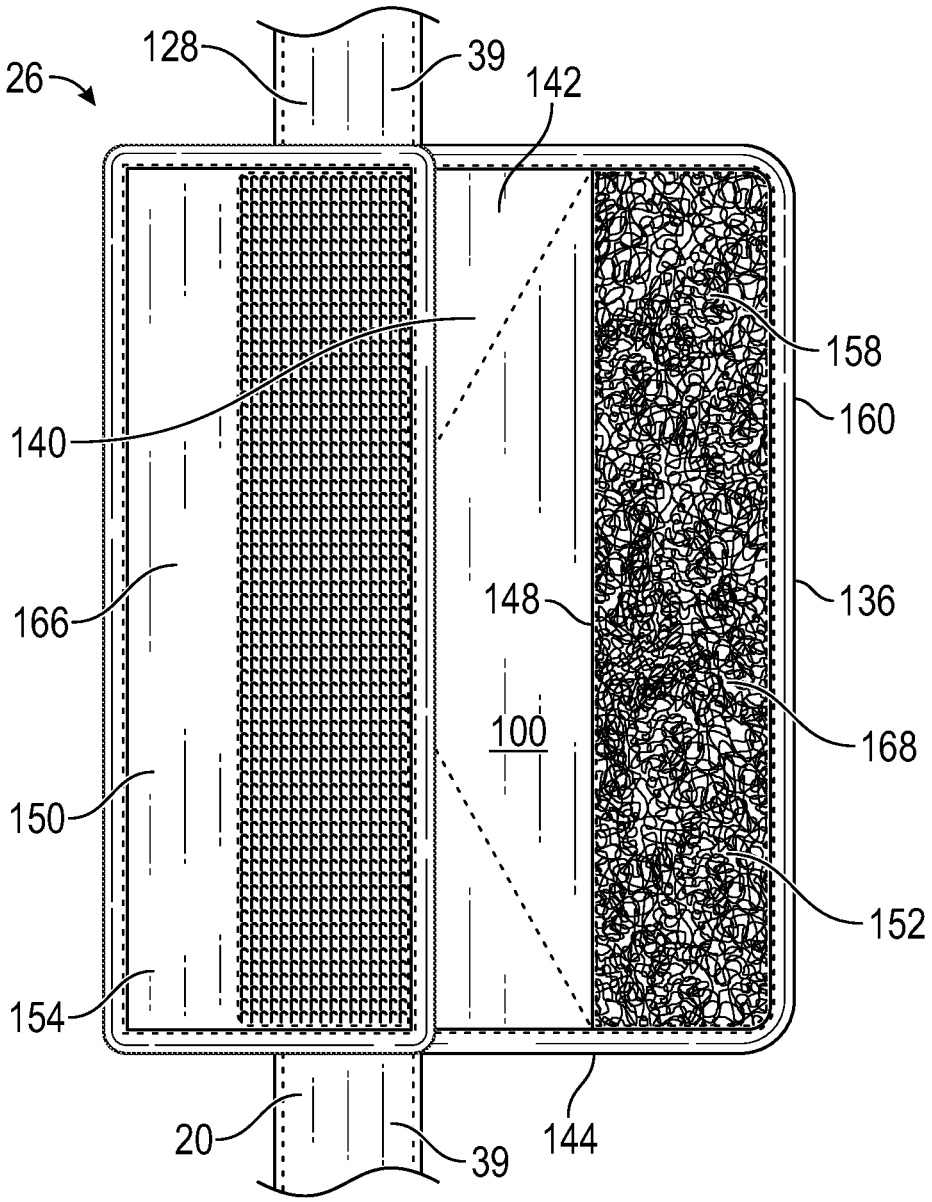
FIG. 5C illustrates a storage pouch and a portion of a strap of FIG. 5A with a wraparound hook and loop fastener component in a partially secured configuration in a third embodiment.

FIG. 5C is a back perspective view illustrating the third storage pouch 26 and a portion of the strap 28 in a partially secured position. In the representative embodiment shown in FIG. 5C, the first complementary element 164 on the inner surface 153 of the inside attachment flap 150 engages the loop element 39 on the front surface 35 of the strap 28.

Figure 5D:
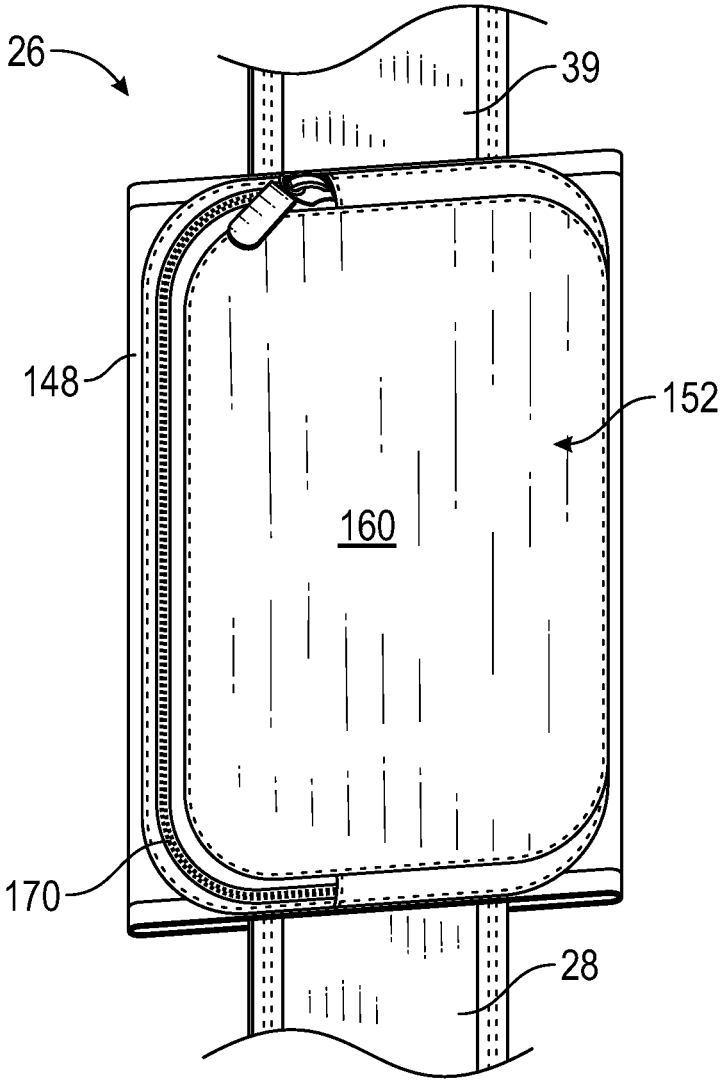
FIG. 5D illustrates a storage pouch and a portion of a strap of FIG. 5A with a wraparound hook and loop fastener component in a completely secured configuration in a third embodiment.

FIG. 5D is a back perspective view illustrating the third storage pouch 22 and a portion of the strap 28 in a completely secured position. In the representative embodiment shown in FIG. 5D, the first complementary element 164 on the inner surface 153 of the inside attachment flap 110 engages the first element 168 on the front surface 39 of the strap 28 and the first element 168 on the inner surface 158 of the outside attachment flap 152 engages the second complementary element 166 on the outer surface 154 of the inside attachment flap 150.

A feature illustrated in one of the figures may be the same as or similar to a feature illustrated in another of the figures. Similarly, a feature described in connection with one of the figures may be the same as or similar to a feature described in connection with another of the figures. The same or similar features may be noted by the same or similar reference characters unless expressly described otherwise. Additionally, the description of a particular figure may refer to a feature not shown in the particular figure. The feature may be illustrated in and/or further described in connection with another figure.

Elements of processes (i.e, methods) described herein may be executed in one or more ways such as by a human, by a processing device, by mechanisms operating automatically or under human control, and so forth. Additionally, although various elements of a process may be depicted in the figures in a particular order, the elements of the process may be performed first storage pouch inner attachment flap in one or more different orders without departing from the substance and spirit of the disclosure herein.

The foregoing description sets forth numerous specific details such as examples of specific systems, components, methods and so forth, in order to provide a good understanding of several implementations. It will be apparent to one skilled in the art, however, that at least some implementations may be practiced without these specific details. In other instances, well-known components or methods are not described in detail or are presented in simple block diagram format in order to avoid unnecessarily obscuring the present implementations. Thus, the specific details set forth above are merely exemplary. Particular implementations may vary from these exemplary details and still be contemplated to be within the scope of the present implementations.

Related elements in the examples and/or embodiments described herein may be identical, similar, or dissimilar in different examples. For the sake of brevity and clarity, related elements may not be redundantly explained. Instead, the use of a same, similar, and/or related element names and/or reference characters may cue the reader that an element with a given name and/or associated reference character may be similar to another related element with the same, similar, and/or related element name and/or reference character in an example explained elsewhere herein. Elements specific to a given example may be described regarding that particular example. A person having ordinary skill in the art will understand that a given element need not be the same and/or similar to the specific portrayal of a related element in any given figure or example in order to share features of the related element.

It is to be understood that the foregoing description is intended to be illustrative and not restrictive. Many other implementations will be apparent to those of skill in the art upon reading and understanding the above description. The scope of the present implementations should, therefore, be determined with reference to the appended claims, along with the full scope of equivalents to which such claims are entitled.

The foregoing disclosure encompasses multiple distinct examples with independent utility. While these examples have been disclosed in a particular form, the specific examples disclosed and illustrated above are not to be considered in a limiting sense as numerous variations are possible. The subject matter disclosed herein includes novel and non-obvious combinations and sub-combinations of the various elements, features, functions and/or properties disclosed above both explicitly and inherently. Where the disclosure or subsequently filed claims recite "a" element, "a first" element, or any such equivalent term, the disclosure or claims is to be understood to incorporate one or more such elements, neither requiring nor excluding two or more of such elements.

As used herein "same" means sharing all features and "similar" means sharing a substantial number of features or sharing materially important features even if a substantial number of features are not shared. As used herein "may" should be interpreted in a permissive sense and should not be interpreted in an indefinite sense. Additionally, use of "is" regarding examples, elements, and/or features should be interpreted to be definite only regarding a specific example and should not be interpreted as definite regarding every example. Furthermore, references to "the disclosure" and/or "this disclosure" refer to the entirety of the writings of this document and the entirety of the accompanying illustrations, which extends to all the writings of each subsection of this document, including the Title, Background, Brief description of the Drawings, Detailed Description, Claims, Abstract, and any other document and/or resource incorporated herein by reference.

As used herein regarding a list, "and" forms a group inclusive of all the listed elements. For example, an example described as including A, B, C, and D is an example that includes A, includes B, includes C, and also includes D. As used herein regarding a list, "or" forms a list of elements, any of which may be included. For example, an example described as including A, B, C, or D is an example that includes any of the elements A, B, C, and D. Unless otherwise stated, an example including a list of alternatively-inclusive elements does not preclude other examples that include various combinations of some or all of the alternatively-inclusive elements. An example described using a list of alternatively inclusive elements includes at least one element of the listed elements. However, an example described using a list of alternatively inclusive elements does not preclude another example that includes all of the listed elements. And an example described using a list of alternatively-inclusive elements does not preclude another example that includes a combination of some of the listed elements. As used herein regarding a list, "and/or" forms a list of elements inclusive alone or in any combination. For example, an example described as including A, B, C, and/or D is an example that may include A alone, A and B, A, B and C, A, B, C, and D, and so forth. The bounds of an "and/or" list are defined by the complete set of combinations and permutations for the list.

Where multiples of a particular element are shown in a FIG., and where it is clear that the element is duplicated throughout the FIG., only one label may be provided for the element, despite multiple instances of the element being present in the FIG. Accordingly, other instances in the FIG. of the element having identical or similar structure and/or function may not have been redundantly labeled. A person having ordinary skill in the art will recognize based on the disclosure herein redundant and/or duplicated elements of the same FIG. Despite this, redundant labeling may be included where helpful in clarifying the structure of the depicted examples.

The Applicant(s) reserves the right to submit claims directed to combinations and sub-combinations of the disclosed examples that are believed to be novel and non-obvious. Examples embodied in other combinations and sub-combinations of features, functions, elements and/or properties may be claimed through amendment of those claims or presentation of new claims in the present application or in a related application. Such amended or new claims, whether they are directed to the same example or a different example and whether they are different, broader, narrower, or equal in scope to the original claims, are to be considered within the subject matter of the examples described herein.

The invention claimed is:

1. A device, comprising:

a strap configured to position over a shoulder and across a torso of a user made from seat belt webbing, wherein the strap has a width of 2 inches, the strap comprising a front portion and a back portion, wherein:

the front portion has a front portion front surface, a front portion top end, a front portion bottom end, wherein the front portion front surface includes a front portion loop component of a hook and loop fastener, the hook and loop fastener comprising a loop component and a hook component, and wherein the front portion loop component extends from the front portion top end to the front portion bottom end; and the back portion has a back portion top end and a back portion bottom end, a first cubic storage pouch attached to the front portion of the strap, the first storage pouch comprising a first storage pouch enclosure defined by:

a first storage pouch top surface, the top surface comprising a first storage pouch top surface top, a first storage pouch top surface bottom, the first storage pouch top surface comprising a first storage pouch top surface inner bottom surface and a first storage pouch top surface outer bottom surface, and first and second first storage pouch top surface opposing sides, a first storage pouch bottom surface, the bottom surface comprising a first storage pouch bottom surface top, a first storage pouch bottom surface bottom, the first storage pouch bottom surface comprising a first storage pouch bottom surface inner bottom surface and a first storage pouch bottom surface outer bottom surface and first and second first storage pouch bottom surface opposing sides, a first storage pouch bottom surface inner bottom surface and a first storage pouch bottom surface outer bottom surface, a first storage pouch first side surface, the first storage pouch first side surface comprising a first storage pouch first side surface top, a first storage pouch first side surface bottom and first and second first storage pouch side surface opposing sides, a second first storage pouch side surface, the second storage pouch first side surface comprising a second storage pouch first side surface top, a second storage pouch first side surface bottom and first and second storage pouch side surface opposing sides, a third first storage pouch side surface, the third storage pouch first side surface comprising a third storage pouch first side surface top, a third storage pouch first side surface bottom and first and second third storage pouch side surface opposing sides, a fourth first storage pouch side surface, the fourth storage pouch first side surface comprising a fourth storage pouch first side surface top, a fourth storage pouch first side surface bottom and first and second fourth storage pouch side surface opposing sides, wherein the first storage pouch has a length of 7 inches, a width of 3 inches and a height of 1 inch, a first storage pouch inside attachment flap comprising a first storage pouch inside attachment flap inner surface and a first storage pouch inside attachment flap outer surface, wherein the first storage pouch inside attachment flap has a length of 7 inches and a width of 2 inches and extends from the first storage pouch first opposing side, and is movable between secured and unsecured positions, a first storage pouch outside attachment flap comprising a first storage pouch outside attachment flap inner surface and a first storage pouch outside attachment flap outer surface, wherein the first storage pouch outside attachment flap has a length of 7 inches and a width of 2 inches and extends from the first storage pouch second opposing side and is movable between secured and unsecured positions, and a first hook component of a hook and loop fastener attaching the first storage pouch to the front portion loop component, the first hook component comprising:

a first hook component first hook element on the first storage pouch inner attachment flap inner bottom surface, and extending the length of the first storage pouch inner attachment flap inner bottom surface and engaging the front portion loop component, a first hook component second hook element on the first storage pouch inner attachment flap outer bottom surface, and extending the length of the first storage pouch inner attachment flap outer bottom surface, a first hook component loop element on the first storage pouch outer attachment flap inner bottom surface, extending the length of the first storage pouch outer attachment flap inner bottom surface, overlapping the first storage pouch inner attachment flap, and engaging the first hook component second hook element, and a second cubic storage pouch attached to the front portion of the strap, the second storage pouch comprising a second storage pouch enclosure defined by:

a second storage pouch top surface, the top surface comprising a second storage pouch top surface top, a second storage pouch top surface bottom, and first and second storage pouch top surface opposing sides, a second storage pouch bottom surface, the bottom surface comprising a second storage pouch bottom surface top, a second storage pouch bottom surface bottom, the second storage pouch bottom comprising a second storage pouch bottom inner bottom surface and a second storage pouch bottom outer bottom surface, and first and second storage pouch bottom surface opposing sides, a second storage pouch first side surface, the second storage pouch first side surface comprising a second storage pouch first side surface top, a second storage pouch first side surface bottom and first and second storage pouch side surface opposing sides, a second storage pouch second side surface, the second storage pouch second side surface comprising a second storage pouch second side surface top, a second storage pouch second side surface bottom and first and second storage pouch side surface opposing sides, a second storage pouch third side surface, the second storage pouch third side surface comprising a second storage pouch third side surface top, a second storage pouch third side surface bottom and first and second third storage pouch side surface opposing sides, a second storage pouch fourth side surface, the second storage pouch fourth side surface comprising a second storage pouch fourth side surface top, a second storage pouch fourth side surface bottom and first and second fourth storage pouch side surface opposing sides, wherein the second storage pouch has a length of 7 inches, a width of 3 inches and a height of 0.5 inch, a second storage pouch inside attachment flap comprising a second storage pouch inside attachment flap inner surface and a second storage pouch inside attachment flap outer surface, wherein the second storage pouch inside attachment flap has a length of 7 inches and wherein the second storage pouch inside attachment flap extends from the second storage pouch first opposing side and is movable between secured and unsecured positions, a second storage pouch outside attachment flap comprising a second storage pouch outside attachment flap inner surface and a second storage pouch outside attachment flap outer surface, wherein the second storage pouch outside attachment flap has a length of 7 inches and wherein the second storage pouch outside attachment flap extends from the second storage pouch second opposing side and is movable between secured and unsecured positions, a second hook component of a hook and loop fastener attaching the second storage pouch to the front portion loop component, the first hook component comprising:

a second hook component first hook element on the second storage pouch inner attachment flap inner bottom surface, and extending the length of the second storage pouch inner attachment flap inner bottom surface and engaging the front portion loop component, and a second hook component second hook element on the second storage pouch inner attachment flap outer bottom surface, and extending the length of the second storage pouch inner attachment flap outer bottom surface, and a second hook component loop element on the second storage pouch outer attachment flap inner bottom surface, extending the length of the second storage pouch outer attachment flap inner bottom surface, overlapping the second storage pouch inner attachment flap, and engaging the second hook component second hook element, a third hook component of a hook and loop fastener attaching the third storage pouch to the front portion loop component, the third hook component comprising:

a third hook component first hook element on the third storage pouch inner attachment flap inner bottom surface, extending the length of the third storage pouch inner attachment flap inner bottom surface, and engaging the front portion loop component, and a third hook component second hook element on the third storage pouch inner attachment flap outer bottom surface and extending the length of the second third storage pouch inner attachment flap outer bottom surface, and a third hook component loop element on the third storage pouch outer attachment flap inner bottom surface, extending the length of the second third storage pouch outer attachment flap inner bottom surface, overlapping the third storage pouch inner attachment flap and engaging the second hook component second hook element, a zipper in one of the opposing side surfaces providing access to the enclosure, and a third cubic storage pouch attached to the front portion of the strap, the third storage pouch comprising a third storage pouch enclosure defined by:

a third storage pouch top surface, the top surface comprising a third storage pouch top surface top, a third storage pouch top surface bottom, and first and second third storage pouch top surface opposing sides, a third storage pouch bottom surface, the bottom surface comprising a third storage pouch bottom surface top, a third storage pouch bottom surface bottom, the third storage pouch bottom comprising a third storage pouch bottom inner bottom surface and a third storage pouch bottom outer bottom surface, and first and second third storage pouch bottom surface opposing sides, a third storage pouch first side surface, the third storage pouch first side surface comprising a third storage pouch first side surface top, a third storage pouch first side surface bottom and first and second third storage pouch side surface opposing sides, a third storage pouch second side surface, the third storage pouch second side surface comprising a third storage pouch second side surface top, a third storage pouch third side surface bottom and first and second third storage pouch side surface opposing sides, a third storage pouch third side surface, the third storage pouch third side surface comprising a third storage pouch third side surface top, a third storage pouch third side surface bottom and first and second third storage pouch side surface opposing sides, and a third storage pouch fourth side surface, the third storage pouch fourth side surface comprising a third storage pouch fourth side surface top, a third storage pouch fourth side surface bottom and first and third fourth storage pouch side surface opposing sides, wherein the third storage pouch has a length of 5.5 inches, a width of 3.5 inches and a height of 1 inch, and a third storage pouch inside attachment flap comprising a third storage pouch inside attachment flap inner surface and a third storage pouch inside attachment flap outer surface, wherein:

the third storage pouch inside attachment flap has a length of 7 inches and a width of 2 inches and wherein third storage pouch inside attachment flap extends from the third storage pouch first opposing side and is movable between secured and unsecured positions, a third storage pouch outside attachment flap comprising a third storage pouch outside attachment flap inner surface and a third storage pouch outside attachment flap outer surface, wherein:

the third storage pouch outside attachment flap has a length of 7 inches and a width of 2 inches wherein the third storage pouch outside attachment flap extends from the third storage pouch second opposing side and is movable between secured and unsecured positions, a third storage pouch first hook component of a hook and loop fastener attaching the third storage pouch to the front portion loop component, the third storage pouch first hook component comprising:

a third storage pouch first hook component first hook element on the third storage pouch inner attachment flap inner bottom surface, and extending the length of the first storage pouch inner attachment flap inner bottom surface and engaging the front portion loop component, and a third storage pouch second hook element on the third storage pouch storage pouch inner attachment flap outer bottom surface, and extending the length of the third storage pouch inner attachment flap outer bottom surface, and a third storage pouch loop element on the third storage pouch storage pouch outer attachment flap inner bottom surface, extending the length of the third storage pouch outer attachment flap inner bottom surface, overlapping the third storage pouch storage pouch inner attachment flap, and engaging the third storage pouch second hook element, a third storage pouch second hook component of a hook and loop fastener attaching the third storage pouch to the front portion loop component, the third storage pouch hook component comprising:

a third storage pouch second hook component first hook element on the third storage pouch inner attachment flap inner bottom surface, extending the length of the third storage pouch inner attachment flap inner bottom surface, and engaging the front portion loop component, and a third storage pouch second hook component second hook element on the third storage pouch inner attachment flap outer bottom surface and extending the length of the third storage pouch inner attachment flap outer bottom surface, and a third storage pouch second hook component loop element on the third storage pouch outer attachment flap inner bottom surface, extending the length of the third storage pouch outer attachment flap inner bottom surface, overlapping the third storage pouch inner attachment flap, and engaging the second hook component second hook element, and a third hook component of a hook and loop fastener attaching the third storage pouch to the front portion loop component, the third hook component comprising:

a third hook component first hook element on the third storage pouch inner attachment flap inner bottom surface, extending the length of the third storage pouch inner attachment flap inner bottom surface, and engaging the front portion loop component, and a third hook component second hook element on the third storage pouch inner attachment flap outer bottom surface and extending the length of the second third storage pouch inner attachment flap outer bottom surface, and a third hook component loop element on the third storage pouch outer attachment flap inner bottom surface, extending the length of the second third storage pouch outer attachment flap inner bottom surface, overlapping the third storage pouch inner attachment flap and engaging the second hook component second hook element, a zipper in the top of top surface adjacent one of the opposing side surfaces.

2. The device of claim 1, further comprising a shoulder pad between the front portion top end and the back portion top end.

3. The device of claim 1, further comprising a fastener release buckle between the front portion bottom end and the back portion bottom end.

4. The device of claim 1, further comprising a carabiner clip at the front portion bottom end.

5. A device, comprising:

a strap configured to position over the shoulder of a user, the strap having a width from 2 inches to 4 inches, the strap comprising a front portion and a back portion, wherein the front portion has a front portion front surface, a front portion top end and a front portion bottom end, and a front portion loop component of a hook and loop fastener, the hook and loop fastener comprising a loop component and a hook component, and wherein the front portion loop component extends from the front portion top end to the front portion bottom, wherein the back portion has a back portion top end and a back portion bottom end, a first pouch configured to releasably attach to the front portion of the strap, the first pouch having an enclosure defined by:

a first pouch top surface, the top surface comprising a first pouch top surface top, a first pouch top surface bottom, the first pouch top surface comprising a first pouch top surface inner bottom surface and a first pouch top surface outer bottom surface, and first and second first pouch top surface opposing sides, a first pouch bottom surface, the bottom surface comprising a first pouch bottom surface top, a first storage pouch bottom surface bottom, the first pouch bottom surface comprising a first pouch bottom surface inner bottom surface and a first pouch bottom surface outer bottom surface and first and second first pouch bottom surface opposing sides, a first pouch bottom surface inner bottom surface and a first pouch bottom surface outer bottom surface, a first pouch first side surface, the first pouch first side surface comprising a first pouch first side surface top, a first pouch first side surface bottom and first and second first pouch first side surface opposing sides, the first pouch first side surface having a length of from 5 inches to 7 inches, a width of from 2.5 inches to 4 inches and a height of 0.5 inch to 1.5 inch, a first pouch second side surface, the first pouch second side surface comprising a first pouch second side surface top, a first pouch second side surface bottom and first and second first pouch second side surface opposing sides, the first pouch first second side surface having a length of from 5 inches to 7 inches, a width of from 2.5 inches to 4 inches and a height of 0.5 inch to 1.5 inch, a first pouch third side surface, the first pouch third side surface comprising a first pouch third side surface top, a first pouch third side surface bottom and first and second first pouch third side surface opposing sides, the first pouch first third side surface having a length of from 5 inches to 7 inches, a width of from 2.5 inches to 4 inches and a height of 0.5 inch to 1.5 inch, a first pouch fourth side surface, the first pouch fourth side surface comprising a first pouch fourth side surface top, a first pouch fourth side surface bottom and first and second first pouch fourth side surface opposing sides, the first pouch first fourth side surface having a length of from 5 inches to 7 inches, a width of from 2.5 inches to 4 inches and a height of 0.5 inch to 1.5 inch, a first pouch inside attachment flap comprising a first pouch inside attachment flap inner surface and a first pouch inside attachment flap outer surface, wherein:

the first pouch inside attachment flap has a length of from 5 inches to 7 inches and a width of from 2.5 inches to 4 inches and wherein first pouch inside attachment flap extends from the third storage pouch first opposing side and is movable between secured and unsecured positions, a first pouch outside attachment flap comprising a first pouch outside attachment flap inner surface and a first pouch outside attachment flap outer surface, wherein:

the first pouch outside attachment flap has a length of 5 inches to 7 inches and a width of from 2.5 inches to 4 inches and wherein the first pouch outside attachment flap extends from the first pouch second opposing side and is movable between secured and unsecured positions, a first pouch first hook component configured to attach the first pouch to the front portion loop component, wherein the first pouch first hook component comprises:

a first pouch first hook element on the first pouch inner attachment flap inner bottom surface and extending the length of the first pouch inner attachment flap inner bottom surface and configured to engage the front portion loop component, and a first pouch second hook element on the first pouch inner attachment flap outer bottom surface and extending the length of the first pouch inner attachment flap outer bottom surface of the first pouch inner attachment flap and a first pouch loop element on the first pouch outer attachment flap inner bottom surface extending the length of the first pouch inner attachment flap inner bottom surface and configured to overlap the first pouch outer attachment flap inner attachment flap and engage second hook element, and a second pouch configured to releasably attach to the front portion of the strap, the second pouch having an enclosure defined by:

a second pouch top surface, the top surface comprising a second pouch top surface top, a second pouch top surface bottom, the second pouch top surface comprising a second pouch top surface inner bottom surface and a second pouch top surface outer bottom surface, and first and second pouch top surface opposing sides, a second pouch bottom surface, the bottom surface comprising a second pouch bottom surface top, a second storage pouch bottom surface bottom, the second pouch bottom surface comprising a second pouch bottom surface inner bottom surface and a second pouch bottom surface outer bottom surface and first and second pouch bottom surface opposing sides, a second pouch bottom surface inner bottom surface and a second pouch bottom surface outer bottom surface, a second pouch first side surface, the second pouch first side surface comprising a second pouch first side surface top, a second pouch first side surface bottom and first and second pouch first side surface opposing sides, the second pouch first side surface having a length of from 5 inches to 7 inches, a width of from 2.5 inches to 4 inches and a height of 0.5 inch to 1.5 inch, a second pouch second side surface, the second pouch second side surface comprising a second pouch second side surface top, a second pouch second side surface bottom and first and second pouch second side surface opposing sides, the second pouch first second side surface having a length of from 5 inches to 7 inches, a width of from 2.5 inches to 4 inches and a height of 0.5 inch to 1.5 inch, a second pouch third side surface, the second pouch third side surface comprising a second pouch third side surface top, a second pouch third side surface bottom and first and second pouch third side surface opposing sides, the second pouch first third side surface having a length of from 5 inches to 7 inches, a width of from 2.5 inches to 4 inches and a height of 0.5 inch to 1.5 inch, a second pouch fourth side surface, the second pouch fourth side surface comprising a second pouch fourth side surface top, a second pouch fourth side surface bottom and first and second pouch fourth side surface opposing sides, the second pouch first fourth side surface having a length of from 5 inches to 7 inches, a width of from 2.5 inches to 4 inches and a height of 0.5 inch to 1.5 inch, a second pouch inside attachment flap comprising a second pouch inside attachment flap inner surface and a second pouch inside attachment flap outer surface, wherein:

the second pouch inside attachment flap has a length of from 5 inches to 7 inches and a width of from 2.5 inches to 4 inches and wherein second pouch inside attachment flap extends from the second storage pouch first opposing side and is movable between secured and unsecured positions, a second pouch outside attachment flap comprising a second pouch outside attachment flap inner surface and a second pouch outside attachment flap outer surface, wherein:

the second pouch outside attachment flap has a length of 5 inches to 7 inches and a width of from 2.5 inches to 4 inches and wherein the second pouch outside attachment flap extends from the second pouch second opposing side and is movable between secured and unsecured positions, a second pouch first hook component configured to attach the second pouch to the front portion loop component, wherein the second pouch first hook component comprises:

a second pouch first hook element on the second pouch inner attachment flap inner bottom surface and extending the length of the second pouch inner attachment flap inner bottom surface and configured to engage the front portion loop component, and a second pouch second hook element on the second pouch inner attachment flap outer bottom surface and extending the length of the first pouch inner attachment flap outer bottom surface of the first pouch inner attachment flap, and a second pouch loop element on the second pouch outer attachment flap inner bottom surface extending the length of the second pouch inner attachment flap inner bottom surface and configured to overlap the second pouch outer attachment flap inner attachment flap and engage second hook element, and pouch closure providing access to the enclosure.

6. The device of claim 5, further comprising a shoulder pad between the front portion top end and the back portion.

7. The device of claim 5, further comprising a fastener release buckle between the front portion bottom end and the back portion bottom end.

8. The device of claim 5, further comprising a carabiner clip at the front portion bottom end.

9. The device of claim 5, wherein the first storage pouch is cubic and has a length of 7 inches, a width of 3 inches and height of 1 inch and the second storage pouch is cubic and has a length of 5.5 inches, a width of 3.5 inches and a height of 1 inch.

10. The device of claim 5, wherein the pouch closure is a hook and loop fastener.

11. The device of claim 5, wherein the pouch closure is a zipper.

12. The device of claim 5, wherein the strap is made of nylon or polyester seat belt webbing.

13. A device, comprising:

a belt comprising a front portion and a back portion, wherein the front portion has a front portion front surface, a front portion top end and a front portion bottom end, and a front portion loop component of a hook and loop fastener, the hook and loop fastener comprising a loop component and a hook component, and wherein the front portion loop component extends from the front portion top end to the front portion bottom, and wherein the back portion has a back portion top end and a back portion bottom end, a first container attached to the front portion of the belt, the first container comprising:

a first container enclosure defining first container first and second opposing surfaces and a first container inside attachment flap having a first container inside attachment flap inner surface, and a first container inside attachment flap outer surface and a first container outside attachment flap having a first container outside attachment flap inner surface and a first container outside attachment flap outer surface, the first attachment flap extending from the first container first opposing surface, a second container attached to the front portion of the belt, the second container comprising:

a second container enclosure defining first and second opposing surfaces and a second container inside attachment flap having a second container inside attachment flap inner surface and a second container inside attachment flap outer surface and a second container outside attachment flap having a second container outside attachment flap inner surface and a second container outside attachment flap outer surface, the second attachment flap extending from the second container second opposing surface, and a first complementary component attaching the first container to the belt by the front portion front surface, the first complementary component comprising:

a first complementary component first complementary element on a first container inner attachment flap inner bottom surface and extending the length of the first container inner attachment flap inner bottom surface and engaging the front portion loop component, a first container inner attachment flap second complementary element on a first container inner attachment flap outer bottom surface and extending the length of the first container inner attachment flap outer bottom surface, a first container first element on a first container outer attachment flap inner bottom surface, extending the length of the first container outer attachment flap inner bottom surface, overlapping the first container inner attachment flap, and engaging the first container second complementary element, a second complementary component first complementary element on a second container inner attachment flap inner bottom surface and extending the length of the second container inner attachment flap inner bottom surface and engaging the front portion loop component, a second container inner attachment flap second complementary element on a second container inner attachment flap outer bottom surface and extending the length of the second container inner attachment flap outer bottom surface, and a second container first element on a second container outer attachment flap inner bottom surface, extending the length of the second container outer attachment flap inner bottom surface, overlapping the second container inner attachment flap, and engaging the first container second complementary element.

14. The device of claim 13, wherein:

the first container has a length of from 5 inches to 7 inches, a width of from 2.5 inches to 4 inches and a height of 0.5 inch to 1.5 inch, the second container has a length of from 5 inches to 7 inches, a width of from 2.5 inches to 4 inches and a height of 0.5 inch to 1.5 inch, the first container inside attachment flap has a length of from 5 inches to 7 inches and a width of from 2.5 inches to 4 inches, the first container outside attachment flap has a length of from 5 inches to 7 inches and a width of from 2.5 inches to 4 inches, the second container inside attachment flap has a length of from 5 inches to 7 inches and a width of from 2.5 inches to 4 inches, and the second container outside attachment flap has a length of from 5 inches to 7 inches and a width of from 2.5 inches to 4 inches.

15. The device of claim 13, further comprising a shoulder pad between the front portion top end and the back portion.

16. The device of claim 13, further comprising a fastener release buckle between the front portion bottom end and the back portion bottom end.

17. The device of claim 13, further comprising a carabiner clip at the front portion bottom end.

18. The device of claim 13, further comprising a first pouch comprising a closure that is a hook and loop fastener.

19. The device of claim 13, further comprising a second pouch comprising a closure that is a zipper.

* * * * *